US005265728A

United States Patent [19]

Allendorf et al.

[11] Patent Number: 5,265,728

[45] Date of Patent: Nov. 30, 1993

[54] ARRANGEMENT FOR RETAINING BLISTER PACK TABLETS

[75] Inventors: Stephan C. Allendorf, Hoboken, N.J.; Thomas M. Dair, Valley Cottage, N.Y.

[73] Assignee: Berlex Laboratories, Inc., Wayne, N.J.

[21] Appl. No.: 23,423

[22] Filed: Feb. 23, 1993

Related U.S. Application Data

[63] Continuation-in-part of Ser. No. 693,127, Apr. 29, 1991, abandoned.

[51] Int. Cl.[5] ..... B65D 83/04; G07F 11/00

[52] U.S. Cl. ..... 206/534; 206/531; 206/532; 206/538; 221/5; 221/88

[58] Field of Search ..... 206/531, 532, 534, 538, 206/539, 459.5; 220/339; 221/5, 88

[56] References Cited

U.S. PATENT DOCUMENTS

| | | | |
|---|---|---|---|
| 3,283,885 | 11/1966 | Grunewald et al. | 206/534 |
| 3,387,699 | 6/1968 | Heller | 206/531 |
| 3,494,322 | 2/1970 | Dubbels | 206/534 |
| 3,527,190 | 9/1970 | Huck | 206/539 X |
| 3,530,818 | 9/1970 | Secondino . | |
| 3,552,595 | 1/1971 | Gerner et al. | 220/339 X |
| 3,567,013 | 3/1971 | Tannenbaum | 220/339 X |
| 3,579,883 | 5/1971 | Hayes | 206/534 X |
| 3,630,171 | 12/1971 | Huck | 206/534 X |
| 3,651,927 | 3/1972 | Richardson et al. | 221/5 |
| 4,384,649 | 5/1983 | Brodsley | 206/538 |
| 4,660,991 | 4/1987 | Simon | 206/534 X |
| 4,905,866 | 3/1990 | Bartell et al. | 221/5 |
| 5,082,113 | 1/1992 | Romick . | |

FOREIGN PATENT DOCUMENTS

| | | | |
|---|---|---|---|
| 0179743 | 4/1986 | European Pat. Off. | 206/531 |
| 2107692 | 8/1972 | Fed. Rep. of Germany | 206/531 |
| 88147932 | 11/1988 | Fed. Rep. of Germany . | |
| 983413 | 11/1965 | France | 206/534 |
| 8402622 | 3/1986 | Netherlands | 206/534 |
| 1086653 | 10/1967 | United Kingdom | 206/534 |

*Primary Examiner*—Bryon P. Gehman

*Attorney, Agent, or Firm*—Elizabeth A. Bellamy; John R. Moses; I. William Millen

[57] ABSTRACT

An arrangement for retaining blister pack tablets comprises a container with at least a front cover and a rear cover with a blister pack sandwiched therebetween and visible through a window in the front cover. The blister pack includes indicia thereon indicating the order in which the tablets should be taken and the container includes a pointer identifying the first tablet in the array of tablets to be consumed. Preferably, the container includes a daily calendar in the form of a loop or cylinder which is moveable with respect to the container so that a desired starting day can be selected by the user or prescriber. Preferably, the loop or cylinder is lockable in its selected position. In accordance with two embodiments of the invention, front and rear lids are pivoted to the front and rear covers, respectively, to conceal the blister pack until it is necessary to take a tablet.

22 Claims, 13 Drawing Sheets

ARRANGEMENT FOR RETAINING BLISTER PACK TABLETS

CROSS-REFERENCE TO RELATED APPLICATION

This application is a continuation-in-part of U.S. patent application Ser. No. 07/693,127, filed April 29, 1991, now abandoned.

BACKGROUND OF THE INVENTION

1. Field of the Invention

The instant invention relates to containers for tablets, and more particularly, the instant invention relates to containers for retaining, concealing and dispensing tablets arrayed in blister packs and used for purposes such as birth control or hormone replacement therapy (HRT).

2. Technical Considerations and Prior Art

The utilization of birth control or HRT tablets generally requires that the tablets be taken one at a time in a preselected order on a daily basis. The tablets are dispensed in accordance with either a 21-day cycle or a 28-day cycle regime. It has been found that utilizing blister packs arranged in seven columns, one for each day, and either three rows or four rows to make up the 21-day or 28-day cycle, provides a satisfactory approach.

Since the blister packs may be carried around by the user, it is necessary to protect the tablets in the blister pack from damage which may occur over the cycle. This need has resulted in numerous arrangements for retaining blister packs. Many of the prior art packages for retaining birth control blister packs are relatively complex and expensive to manufacture in that they have somewhat elaborate latches and hinges. Moreover, they may from time to time become jammed. These devices are exemplified by the dial type of container disclosed in U.S. Pat. No. 4,165,709. The operation of these dial-type dispensers may not be readily apparent to all users and from time to time mistakes are made in dispensing the tablets due to the complexity of these dispensers. Other types of tablet containers using oval or circular arrangements are exemplified by the containers of U.S. Pat. Nos. 3,283,885 and 4,165,709.

As exemplified perhaps by U.S. Pat. Nos. 3,677,397 and 3,504,788 there are several tablet containers for birth control tablets which have flexible covers. These particular arrangements do not adequately protect the tablets in that pressure applied to the covers can damage the tablets or cause the tablets to be inadvertently dispensed through the trays upon which they are mounted. In order to avoid this, many commercial containers have domed covers.

U.S. Pat. No. 4,817,819 is exemplary of an approach to packaging birth control tablets wherein the tablets are mounted on a sleeve which is retained in a tray; however, this approach requires the separate molding and assembly of two parts.

Trays which have complex and extensive surface contact with the sleeves or covers in which they are received can upon occasion become jammed since debris can collect in convoluted surfaces.

U.S. Pat. Nos. 3,527,190; 3,584,598; 3,579,883; 3,587,517 and 3,630,171 are illustrative of tablet containers which utilize hinged covers. In the past, containers using hinged covers have been relatively expensive in that they require both difficult to configure hinges and latches. These parts must be carefully molded and are subject to wear and breakage. Moreover, when these containers have compartments for dispensed tablets, the tablets tend to become jammed in the openings. Accordingly, prior art containers utilizing hinged covers have several drawbacks.

In view of the aforementioned considerations, there is a need for containers for tablets such as blister packaged birth control tablets, which containers do not have drawbacks such as the drawbacks of the aforediscussed patents. Moreover, there is a need for such containers wherein the container has the general appearance of a discreet cosmetic item.

SUMMARY OF THE INVENTION

It is an object of the instant invention to provide new and improved containers for storing and dispensing supplies of tablets, such as birth control tablets, which must be dispensed during a preselected cycle.

Upon further study of the specification and appended claims, further objects and advantages of this invention will become apparent to those skilled in the art.

In view of the aforementioned object and other objects, the instant invention contemplates an assembly for containing tablets, such as birth control tablets, in an array wherein the assembly comprises a blister pack containing a plurality of tablets disposed in an area of the blister pack and configured in a selected array and a container comprising a deck and cover. The deck of the container includes a flat surface with a plurality of compartments therethrough, the compartments being arranged to correspond to the selected array of tablets in the blister pack. The cover includes a rim portion of an area at least as large as the area of the blister pack and a window portion of an area less than the area of the blister pack and larger than the area of the selected array. The cover is secured to the deck with the blister disposed therebetween, wherein the tablets and blister pack are visible and accessible through the window of the cover and the tablets are dispensable through the openings in the deck by pressing on the tablets through the window.

In accordance with the preferred embodiment of the invention, the container of the assembly is unitary with the deck and cover being formed of one piece.

In accordance with a further embodiment of the invention, the assembly further includes a front lid and a back lid, the front lid being hinged to the cover and the back lid being hinged to the deck. A latch is provided for latching the front and back lids to one another sandwiching the blister pack, cover and deck between the lids.

The instant invention further contemplates utilizing indicating means proximate the window which cooperates with locating means on the blister pack to properly position the blister pack within the container while indicating to the user which tablet in the array should be taken first. In accordance with one embodiment, the indicating means is a lockable cylinder with a day calendar thereon and in accordance with another embodiment the indicating means is a lockable loop with a day calendar thereon.

BRIEF DESCRIPTION OF THE DRAWINGS

Various other objects, features and attendant advantages of the present invention will be more fully appreciated as the same becomes better understood when considered in conjunction with the accompanying drawings in which like reference characters designate the same or similar parts throughout the several views, and wherein.

DETAILED DESCRIPTION OF THE DRAWINGS

Blister Pack Configurations—FIGS. 1-10

Figure 1:
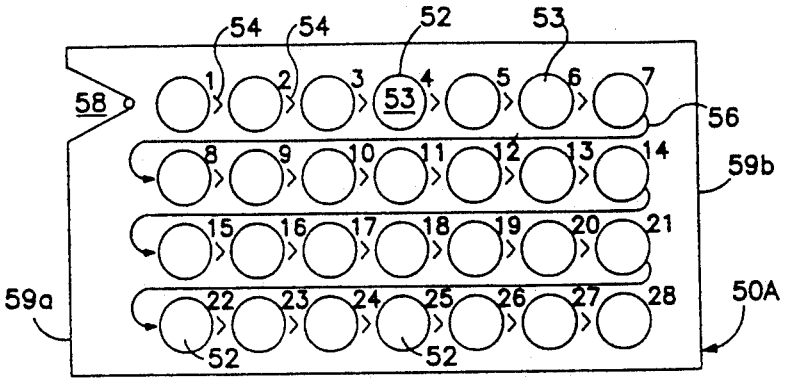
FIGS. 1-10 are top views of blister packs showing various arrangements for indicating the order in which an array of tablets, such as birth control or HRT tablets, should be taken.
Figure 2:
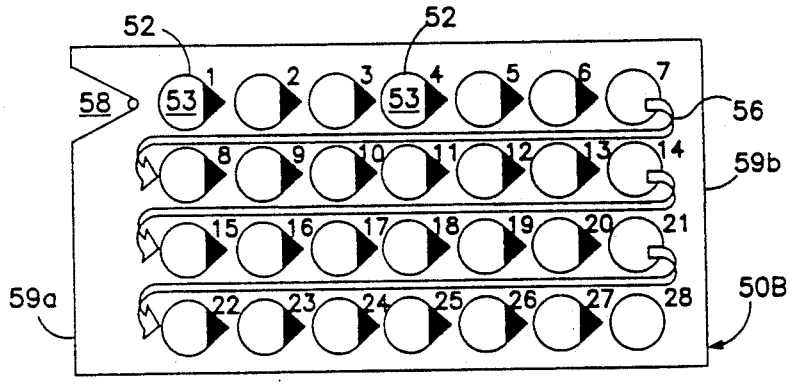
Figure 3:
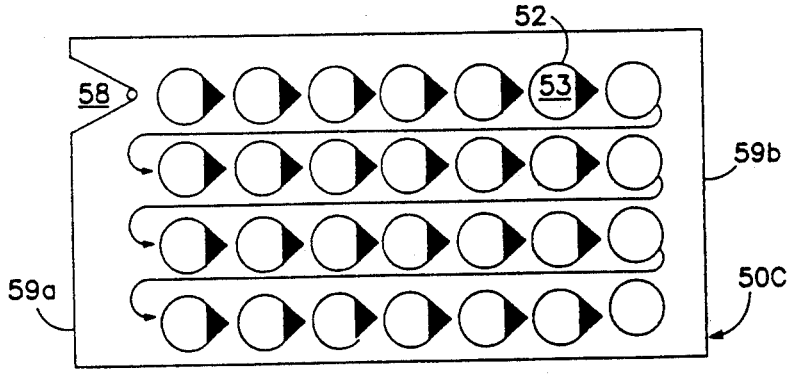
Figure 4:
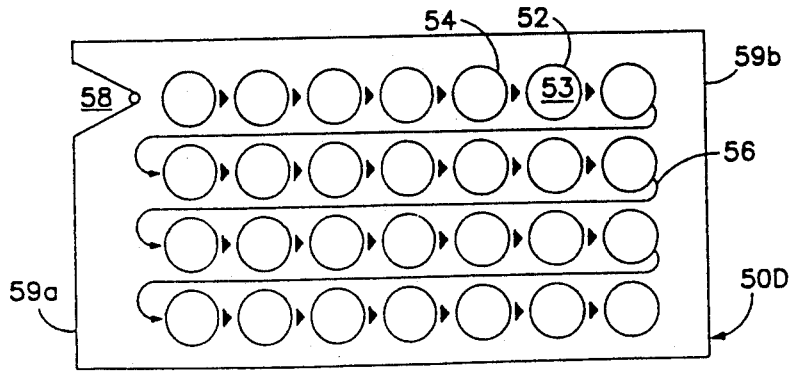
Figure 5:
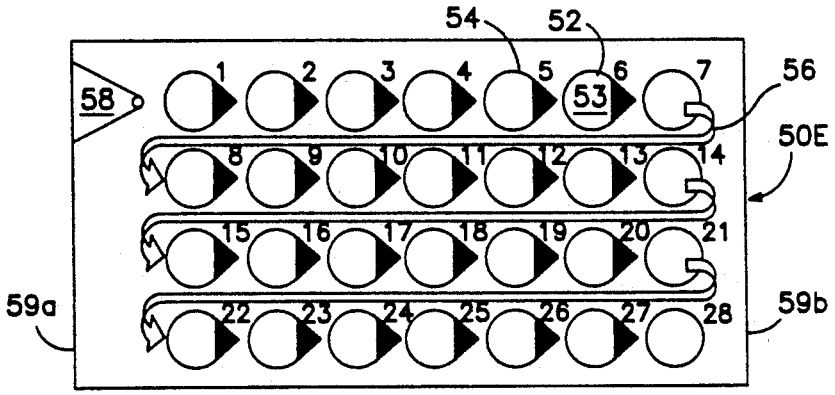
Figure 6:
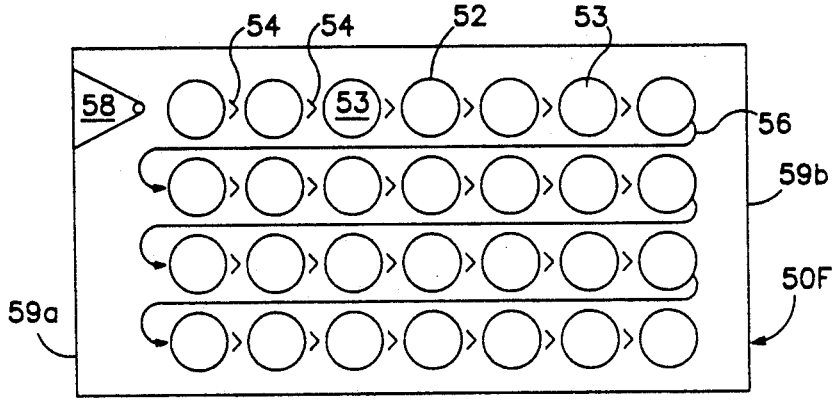
Figure 7:
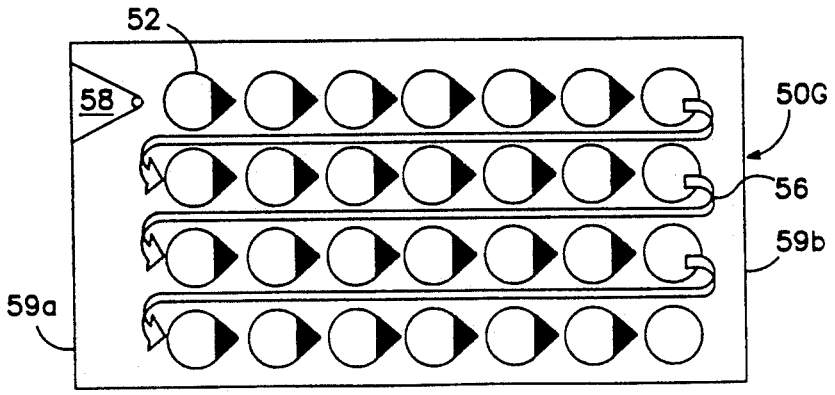
Figure 8:
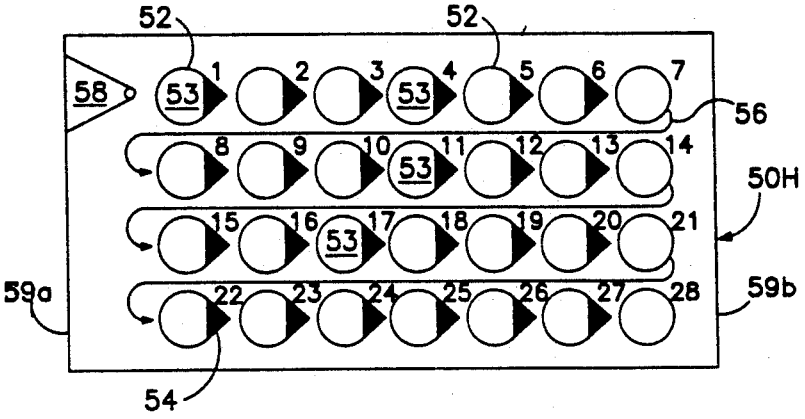
Figure 9:
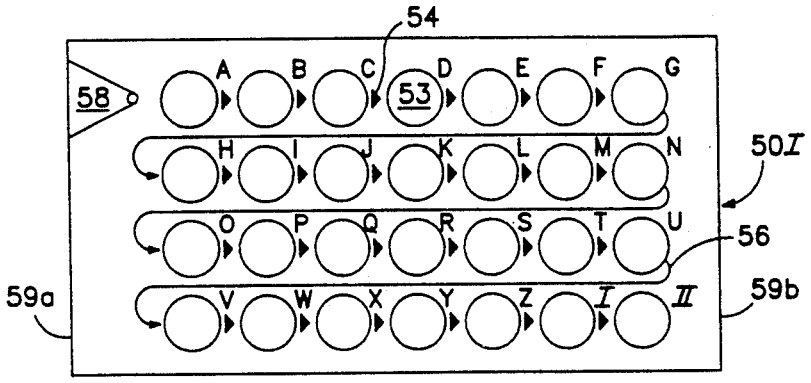
Figure 10:
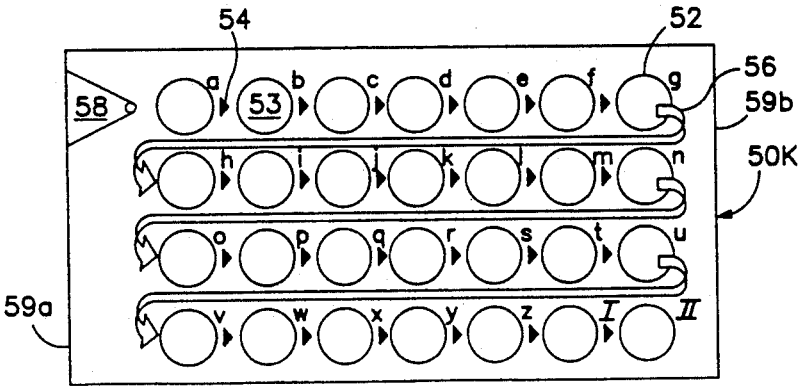

Referring now to FIGS. 1-10, there are shown blister packs designated generally by the numerals 50*a*-50*k*, each of which have twenty-eight compartments 52 therein for receiving tablets, such as birth control or HRT tablets 53, which are taken by a consumer sequentially at a rate of one tablet per day. In order to avoid confusion, indicators in the form of arrows 54 between each compartment 52 in a row and arrows 56 connecting the end of one row to the beginning of the next row are provided. In the illustrated embodiment, the rows of compartments 52 contain seven tablet compartments. There are four rows of tablet compartments 52 to provide for a twenty-eight day cycle. In the embodiments of FIGS. 1, 2, 5 and 8, each tablet compartment 52 is numbered while, in FIGS. 3, 4, 6 and 7, no numbers are used and, in FIGS. 9 and 10, letters are used. Each of the blister packs 50 includes a triangular notch 58 adjacent one edge 59*a* thereof so as to properly locate the blister pack in its respective container, the opposite edge 59*b* being alignable in the container for retaining the blister pack.

Graphics on the blister packs 50*a*-50*k* differ in appearance but all have the function of directing the user to sequentially consume the birth control or HRT tablets 53 in the right order. Without proper instruction, the consumer could possibly not follow the correct order by just selecting any tablet or perhaps taking tablets sequentially from the columns, i.e., vertically with respect to FIGS. 1-10, instead of horizontally. In order to be effective, it is important that the tablets 53 be consumed in the correct sequence.

Since dosages for HRT tablets may be for a 21 instead of a 28 day cycle, the last seven compartments may either be empty or contain non-active tablets.

First Embodiment—FIGS. 11-17

Figure 11:
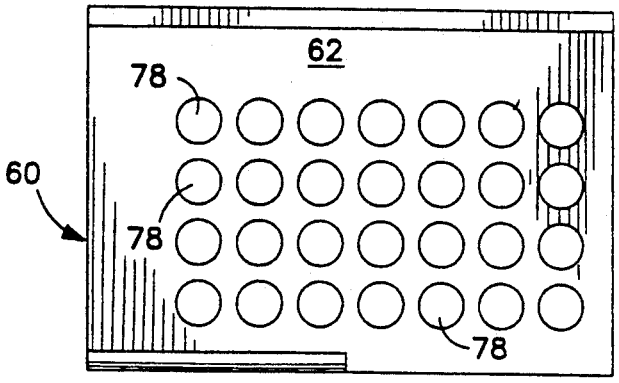
FIG. 11 is a planar view of the front of a first embodiment of a container for one of the blister packs shown in FIGS. 1-10.
Figure 12:
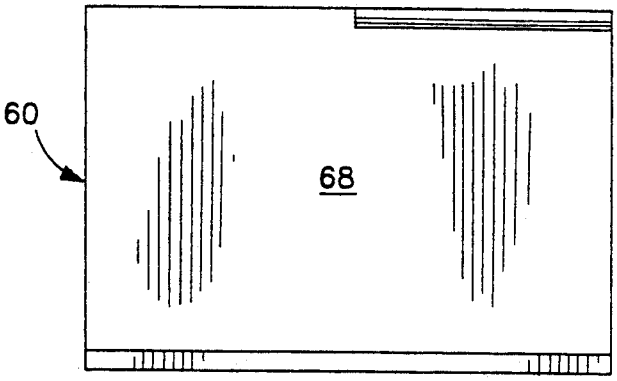
FIG. 12 is a planar view of the rear of the container of FIG. 11.
Figure 13:
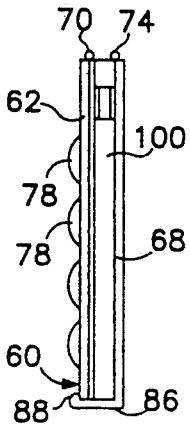
FIG. 13 is a side view of the container of FIGS. 11 and 12.

FIGS. 11-17 disclose a first embodiment of the invention wherein a container, designated generally by the numeral 60 has first, second, third and fourth panels 62, 64, 66 and 68, respectively. As is seen in FIGS. 13-17, panel 62 is joined to panel 64 via a living hinge 70; panel 64 is joined to panel 66 via a living hinge 72; and panel 66 is joined to panel 68 via a living hinge 74. FIGS. 11 and 12 are front and rear views, respectively, showing the container 60 closed with the panels 62-68 folded upon one another accordion fashion in the manner of FIG. 17 to collapse as is illustrated in FIG. 13.

Figure 14:
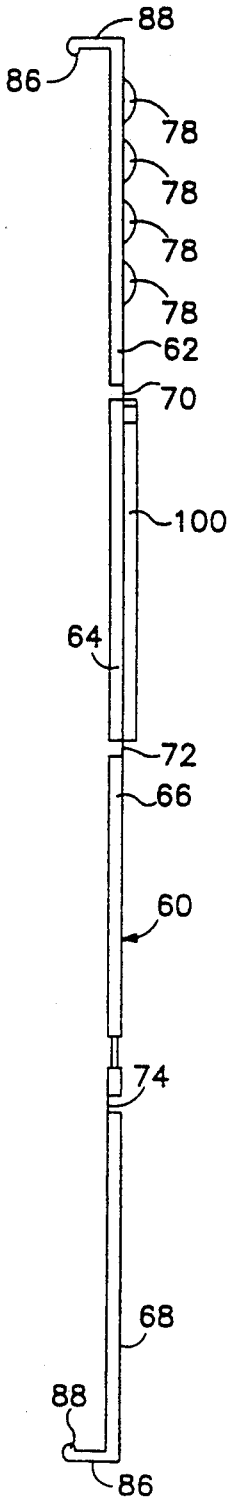
FIG. 14 is a side view of the container of FIGS. 11-13, but shown unfolded.
Figure 15:
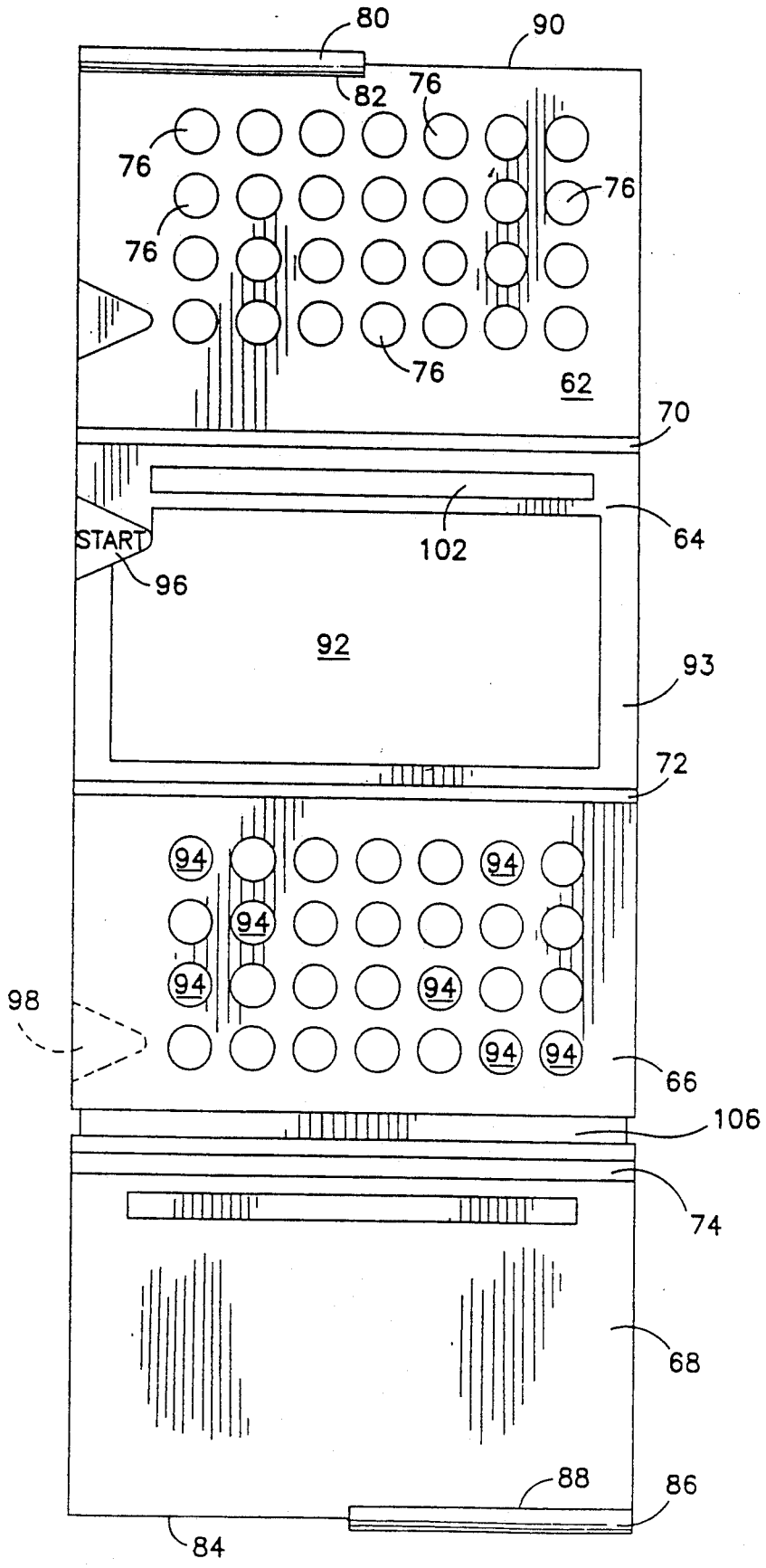
FIG. 15 is a front planar view of a container of FIGS. 11-13 shown unfolded.
Figure 16:
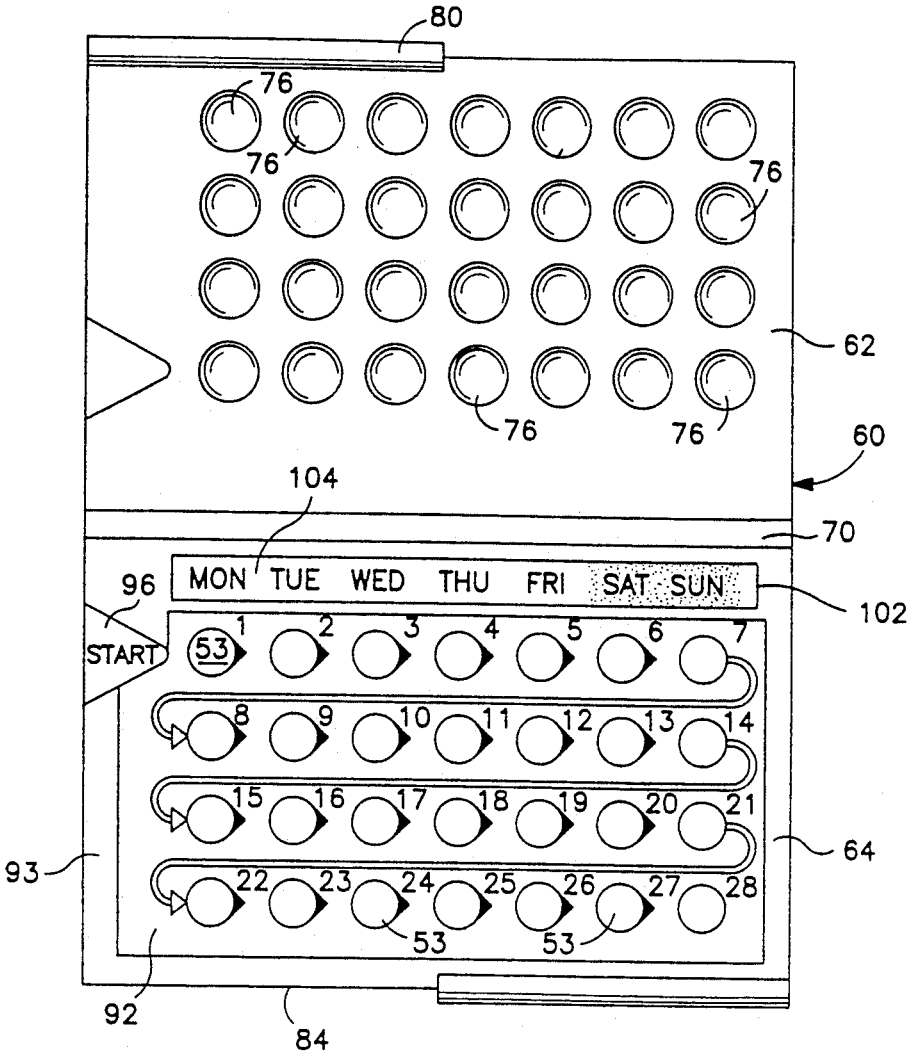
FIG. 16 is a front view of the container of FIGS. 11-13 showing the front cover opened to expose for use an array of tablets on an inserted blister pack.
Figure 17:
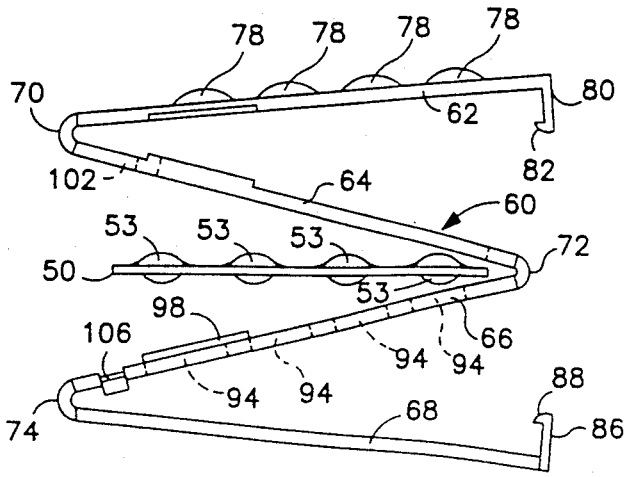
FIG. 17 is a side view of the container of FIGS. 11-13 showing how the blister pack is sandwiched within the container.
Figure 18:
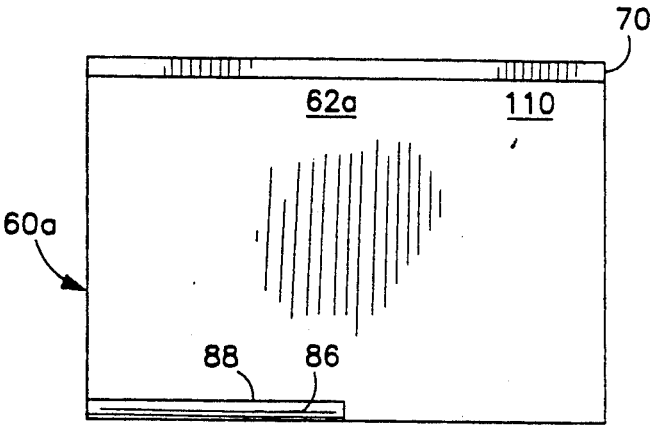
FIG. 18 is a front planar view of a second and preferred embodiment of a blister pack container in accordance with the instant invention.
Figure 19:
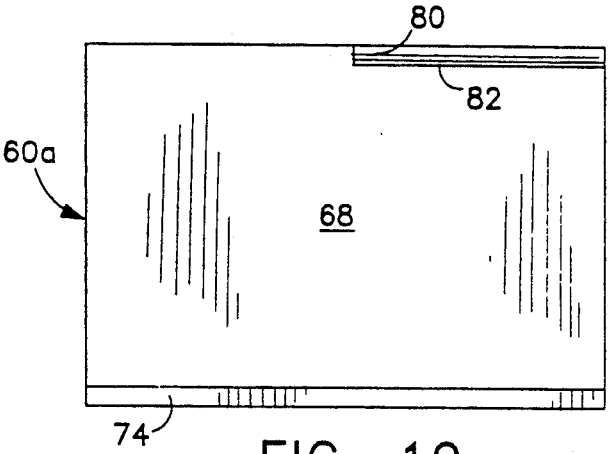
FIG. 19 is a rear view of the container of FIG. 18.
Figure 20:
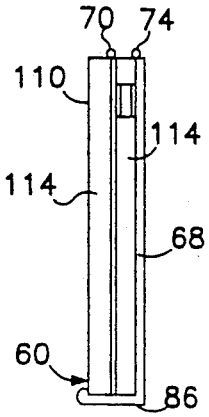
FIG. 20 is a side view of the container of FIGS. 18 and 19.
Figure 21:
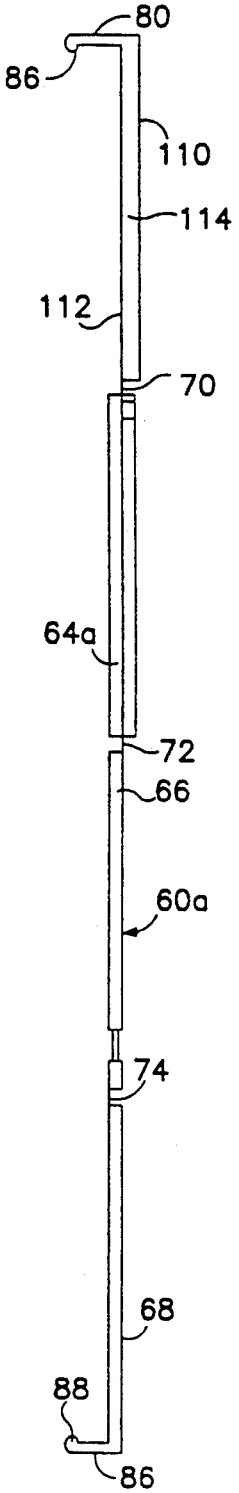
FIG. 21 is a side view of the container of FIGS. 18-20 but showing the container unfolded.

The first panel 62 has an array of concave depressions 76 therein when viewed from the inside as in FIGS. 15 and 16 which appear as convex domes 78 on the outside surface thereof as in FIGS. 11, 13, 14 and 17. As is best seen in FIGS. 14 and 17, the front cover formed by the first panel 62 has a lip 80 projecting therefrom which has a hooked end 82 adapted to snap over an edge 84 (FIG. 15) on the fourth panel 68. Conversely, the fourth panel 68 has a lip 86 with a hook 88 adapted to snap over an edge 90 of the first panel 62 so as to further hold the panels 62 and 68 superimposed with the second and third panels 64 and 66 sandwiched or folded therebetween.

A selected one of the blister packs 50 of FIGS. 1-10 is sandwiched between the second and third panels 64 and 66, respectively, with the tablets 53 facing through a window 92 defined by a rim 93 which comprises the second panel 64. The third panel 66 forms a deck for supporting the blister pack 50 and has an array of twenty-eight openings 94 corresponding to the compartments 52 in the blister pack which hold the birth control tablets 53. Since the tablets 53 are exposed through the window 92 and the blister pack 50 is retained behind the back surface of the panel 64, the tablets may be popped out by pressing the tablets from the front side of the blister pack to pop the tablets through openings 94 in the third panel 66 which forms the deck for supporting the blister pack. The second panel 64 has a V-shaped area 96 which is raised in the front view of FIGS. 15 and 16. Preferably, the word "START" or "FIRST PILL" is printed on the raised surface of the indicator 96.

While the third panel 66 has a raised indicator portion 98 which corresponds in shape to the recessed indicator portion 96 and registers with the notch 58 at the edge 59*a* of pack 50. A lip 100 projecting from the back surface of the panel 64 as is shown in FIG. 14 engages the edge 59*b* of the blister pack 50 mounted between the panels 66 and 64 so as to cooperate with the raised indicator 98 to hold the blister pack in place.

Figure 22:
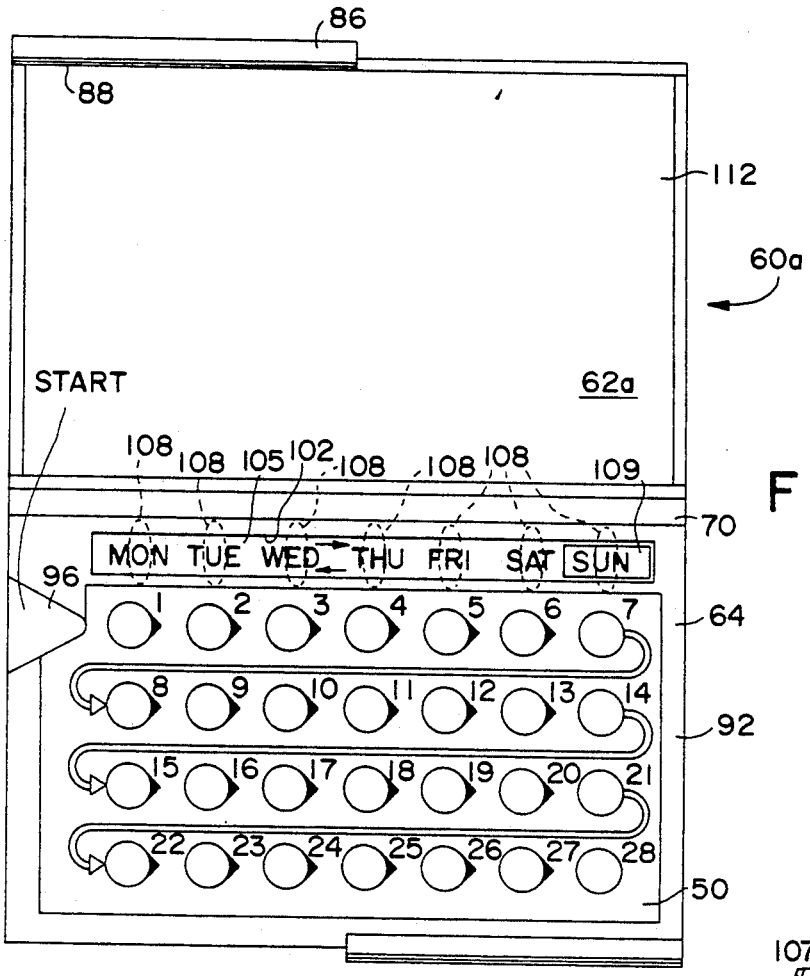
FIG. 22 is a front planar view showing the container of FIGS. 18-20 opened to access birth control tablets on a blister pack therein.
Figure 22A:
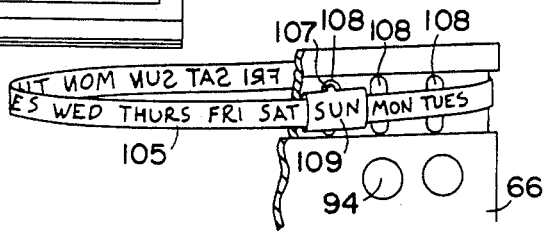
FIG. 22*a* is a perspective view of a preferred loop-type calendar band with a locking detent and operating tab.
Figure 23:
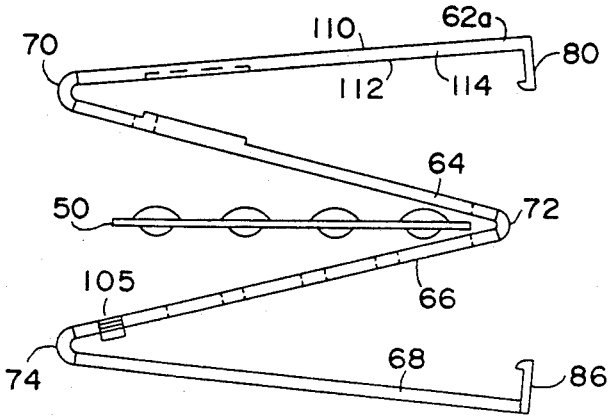
FIG. 23 is a side view showing how a blister pack of tablets is sandwiched in the container of FIGS. 18-22 as the container and blister pack are assembled and folded.

As is seen in FIG. 16 in combination with FIGS. 15, 17 and 22*a*, in order to provide an indicator for the day of the week, a elongated slot 102 is placed in the second panel 64 and a strip 104, preferably in the form of a continuous loop 105 (FIG. 22*a*) with the days of the week, is placed in a recessed area 106 in the third panel 66 so as to be visible through the slot 102 when the container 60 is folded accordion fashion so as to close as is shown in FIGS. 13 and 17. The continuous loop 105 has at thirteen or more days thereon so that the starting day can be easily selected by the patient. As is seen in the preferred embodiment of FIG. 22*a*, a locking detent 107 locks into recesses 108 in the third panel 66 behind the loop 105 to prevent the loop from being moved after a starting day has been selected.

Container 60 is used as is shown in FIG. 16 wherein when the panel 62 is pivoted from its FIG. 12 to its FIG. 16 position the tablets 53 are exposed through the window 92 for dispensing from the blister pack 50. As the tablets 53 are sequentially pressed, they rupture the back surface of the blister pack 50 and pass through the openings 94 in the third panel 66 which is exposed by rotating the fourth panel 68 which forms the rear cover of container 60 to an open position.

The arrangement of FIGS. 11-17 provides a birth control container 60 which conceals the nature of the tablets 53 being dispensed by covering both the front and back side of the blister pack 50. Moreover, the container 60 is fabricated as a unitary, one-piece structure which is folded in a manner readily apparent to the user to perform its function of containing and concealing the blister pack 50.

Second Embodiment—FIGS. 18-23

The second embodiment of the container, designated generally by the numeral 60*a*, is a four-panel container similar to the four-panel container of FIGS. 11-17, with the exception that the first or front panel 62*a* has planar inside and outside surfaces 110 and 112, respectively, instead of having the convex bumps 78 appearing on the outer surface 110 as is the case in the container 60 of FIGS. 11-17. This is accomplished by providing the first panel 62*a*, which is the front cover, with a relatively wide pair of side edge flanges 114 (FIG. 20) so that when the cover is closed, as in FIG. 20, the tablets 53 are concealed behind the side flanges 114. Other than redimensioning the components, especially the height of the side walls 114 of the first panel 62*a* forming the front cover of the container 60*a*, the remainder of the container has a structural configuration substantially similar to that of the first embodiment of FIGS. 11-17.

Preferably, this embodiment utilizes the continuous loop-type calendar band, such as the continuous loop 105 illustrated in FIG. 22*a*. The detent 107 is seated to a selected hole 108 in the loop 105 in order to releasably retain the loop for a selected starting date. In the embodiment of FIGS. 22 and 22*a*, a tab 109 fixed to the loop 105 in alignment with a day of the week, preferably Sunday, projects through the elongated slot 102 through the face of the panel 64. The starting day is selected by sliding the tab 109 in either direction in the slot 102 to move the loop so as to position the selected starting day proximate the starting indicator 96. While the loop 105 is being shifted, the detent 107 is held disengaged from the holes 108 against the bias of the loop. Upon selecting the starting day, the detent 107 is moved to seat in the selected hole 108.

Third Embodiment—FIGS. 24-28

Figure 24:
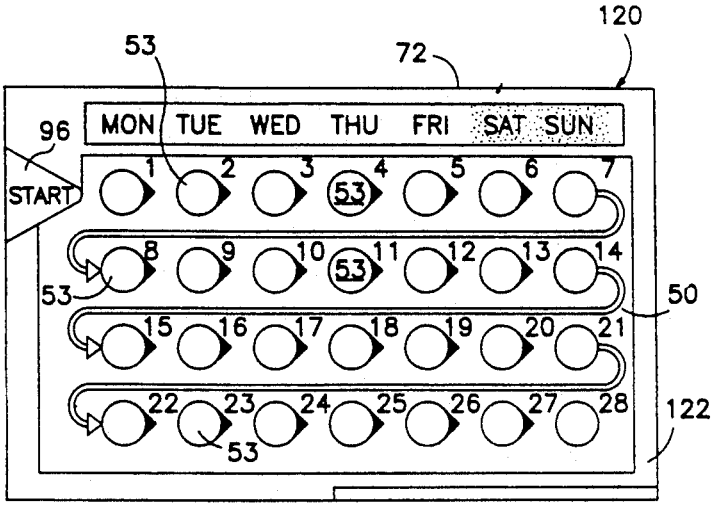
FIG. 24 is a top view of the third embodiment of a blister pack container for tablets retained in a blister pack.
Figure 25:
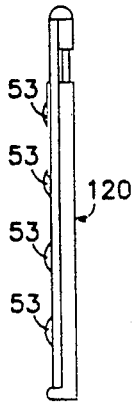
FIG. 25 is a side view of the container of FIG. 24.
Figure 26:
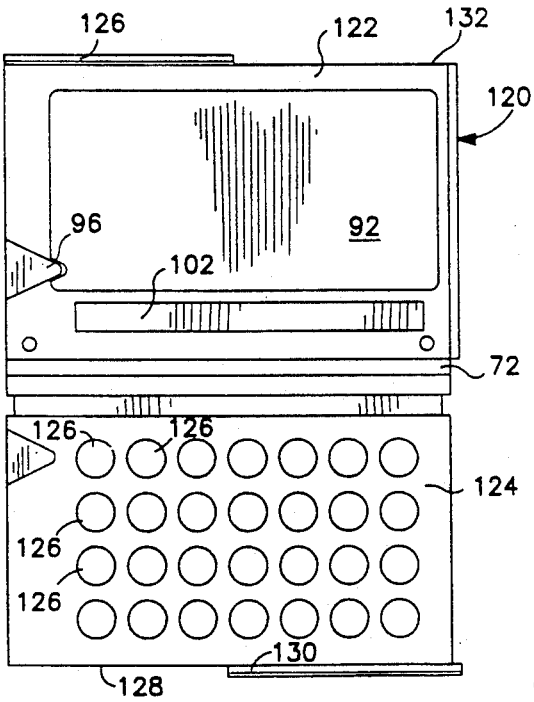
FIG. 26 is a front view showing the container of FIG. 24 opened to receive a blister pack.
Figure 27:
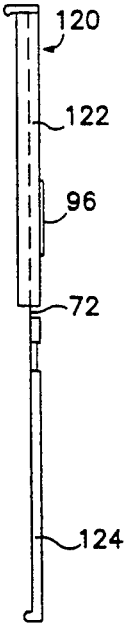
FIG. 27 is a side view of the opened container of FIG. 26.
Figure 28:
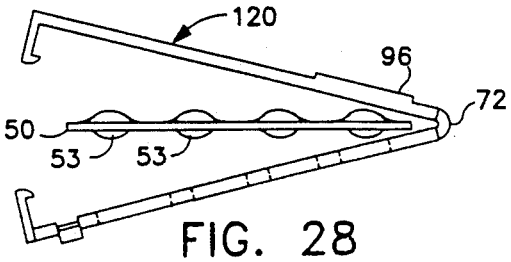
FIG. 28 is a side view showing how a blister pack is retained between front and rear covers of the container of FIGS. 24-27.

In the third embodiment, a container, designated generally by numeral 120 comprises only two panels, front panel 122 and a rear panel 124. In the third embodiment, first and fourth panels 62 and 68 are dispensed with so that the tablets 53 are always visible. As is seen in FIG. 24, there is no front cover over the blister pack 50 and as is seen in FIG. 25, the tablets 53 are individually exposed through the openings 126 in the rear panel 124. As in the first and second embodiments, the blister pack 50 is sandwiched between the front cover 122 and the rear cover 124 with the front cover having a lip 126 which latches over the edge 128 of the rear cover and the rear cover having a lip 130 which latches over the edge 132 of the front cover.

The remaining elements having reference numerals similar to the reference numerals of FIGS. 1-23 are similar structures functioning in similar ways.

Figure 29:
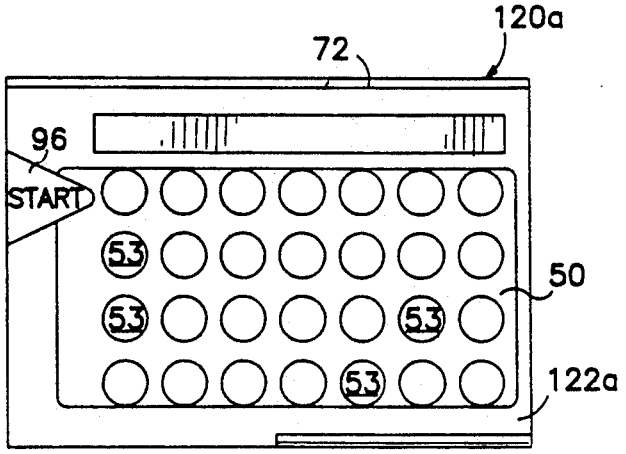
FIG. 29 is a front planar view of a fourth embodiment of the invention showing a transparent blister pack container having a structure similar to the container of FIGS. 24-28.
Figure 30:
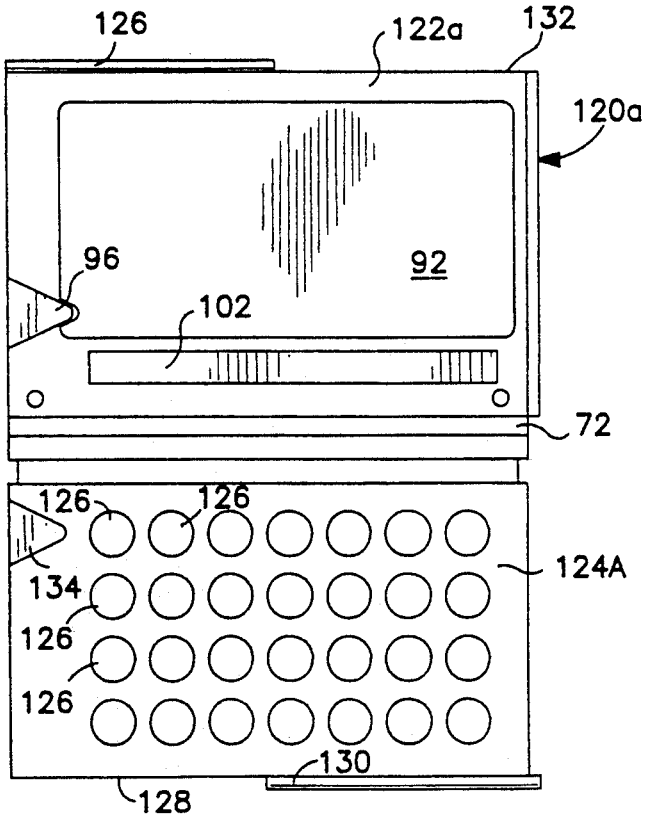
FIG. 30 is a view of the transparent container of FIG. 29 shown open for receiving a blister pack.

Fourth Embodiment—FIGS. 29 and 30

The fourth embodiment of the invention has a structure substantially identical to the third embodiment; however, in the fourth embodiment, the front panel 122*a* and rear panel 124*a* of container 120 are of transparent plastic rather than opaque plastic. The indicator 96 is configured by having the word "START" or "FIRST PILL" placed on the raised triangular area 96 on front panel 122*a* (see FIG. 30).

In another embodiment, the raised triangular area 134 is opaque so that it is visible through the corresponding transparent raised triangular area 136 of the front cover 122*a*. The blister pack 50 is opaque so the raised area 134, which is preferably of a contrasting color to the blister pack, is highlighted to emphasize where the dosage starts by pointing to the "first tablet" 53 in the array of tablets.

Fifth Embodiment—FIGS. 31-35

The fifth embodiment of the tablet container, designated generally by the numeral 140, is essentially similar to the third and fourth embodiments in which the blister pack 50 is retained between a front cover 122*b* and a rear cover 124*b*; however, in the fifth embodiment, a cylindrical calendar retainer 141 is disposed in proximity with the hinge 72*b* which connects the front cover 122*b* to the rear cover 124*b*. Disposed in the circular calendar retainer 141 is a cylindrical calendar, designated generally by the numeral 142, which has seven daily calendars 144 disposed around and extending axially along its surface. Each daily calendar 144 starts with a new day and can be selectively dialed into registration with a window 146 by rotating a knurled knob 148 on the end of the cylinder 142. Means are provided to fix the cylinder 142 in place so that it can not be readily rotated after being set for one cycle.

Figure 31:
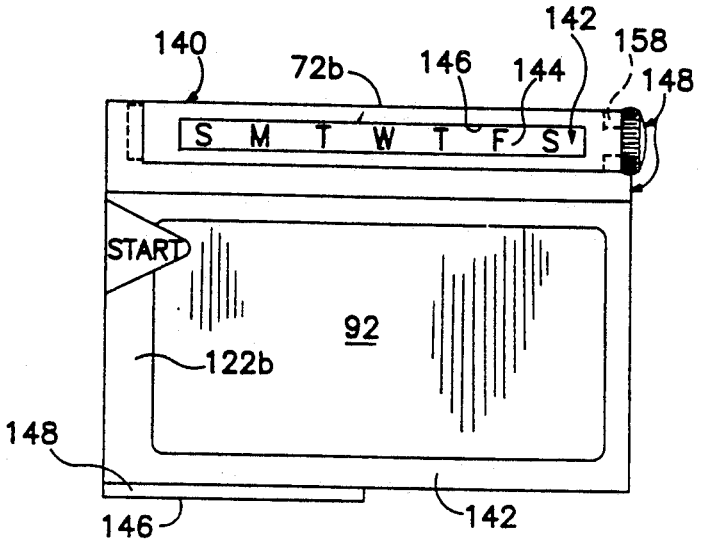
FIG. 31 is a front planar view of a blister pack container according to a fifth embodiment of the invention wherein a calendar wheel is used.
Figure 32:
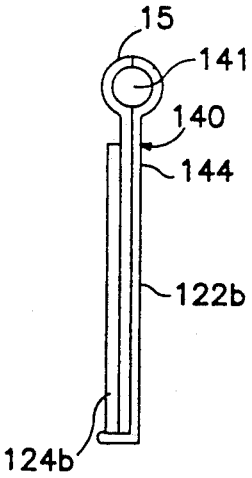
FIG. 32 is a side view of the container of FIG. 31.
Figure 33:
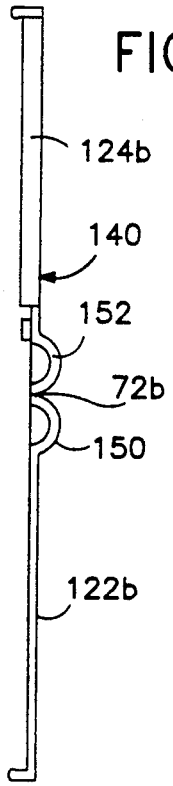
FIG. 33 is a side view of the container of FIGS. 31 and 32 shown opened up.
Figure 34:
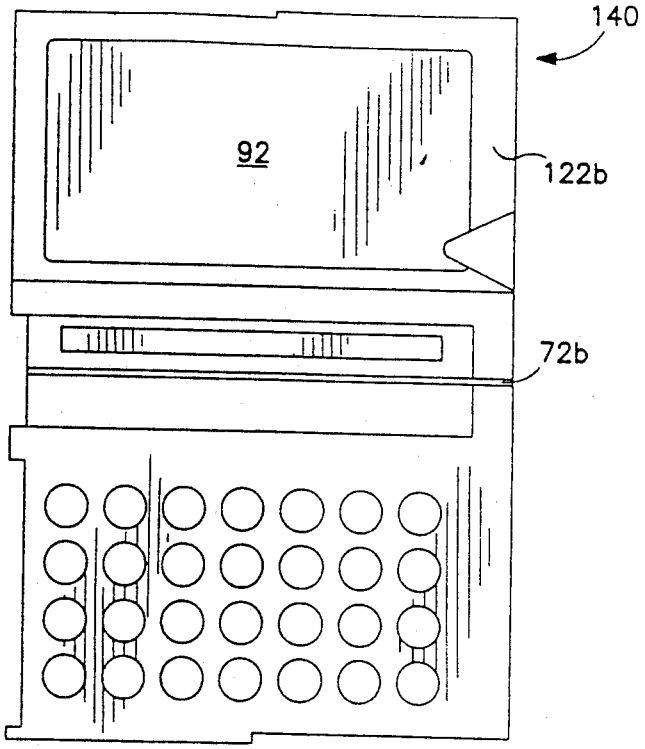
FIG. 34 is a back view of the container of FIGS. 31 and 32 shown opened up.
Figure 35:
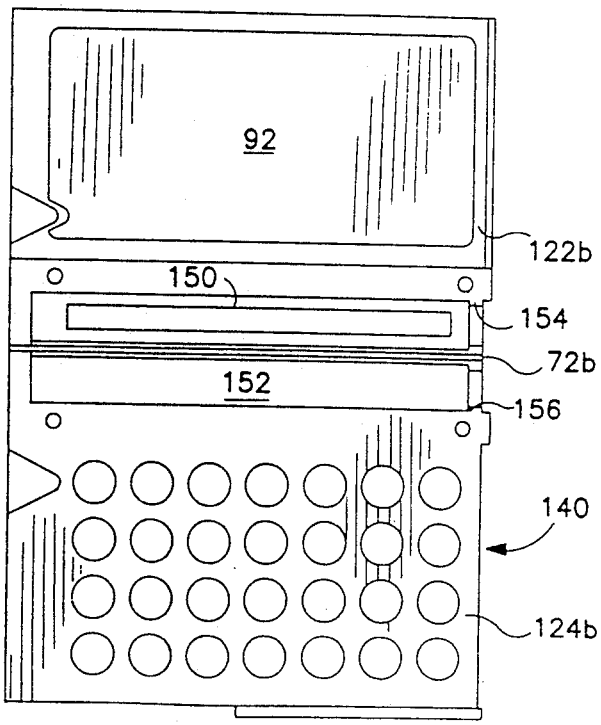
FIG. 35 is a front or inside surface view of the container of FIG. 31 and 32 shown opened up.
Figure 36:
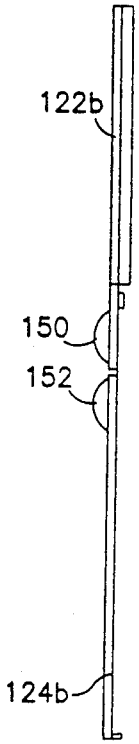
FIG. 36 is an end view of the container of FIG. 31 taken from the opposite end of FIG. 32.

As is seen in FIGS. 31, 32 and 35, calendar retainer 141 is formed by a pair of cooperating cylinder halves 150 and 152 formed in the front and rear covers 122*b* and 124*b*, respectively. When the front and rear covers are closed to sandwich the blister pack 50 therebetween, the cylindrical calendar 142 is retained in the thus formed cylindrical calendar retainer 140. As is seen in FIG. 35, the cylinder halves 150 and 152 each have semi-annular shoulder 154 and 156, respectively, which close around a reduced diameter portion 158 (FIG. 31) of the cylindrical calendar 142. In all other respects, the tablet container 140 is substantially similar to the tablet container 120, with similar reference numerals identifying substantially similar structure.

Figure 39:
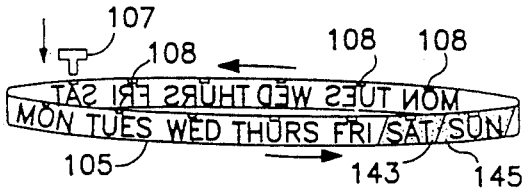
FIG. 39 is a perspective view of a loop-type calendar band with a locking detent.

Sixth Embodiment—FIG. 39

In accordance with a sixth embodiment of the invention, the calendar cylinder 142 or the loop 105, depending on which is used, has the days Saturday 143 and Sunday 145 highlighted or shaded in a color different from the other days to assist the user in coordinating her cycle with her weekly schedule.

Figure 37:
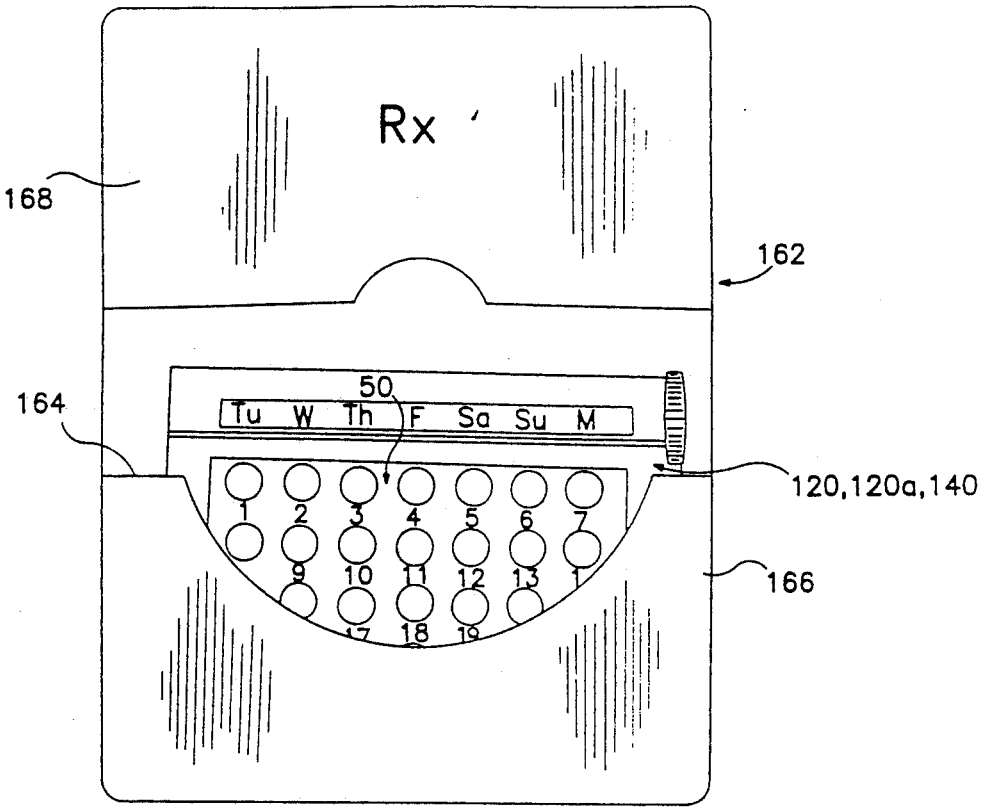
FIG. 37 is a planar view of the container of FIGS. 24-36 stored in a holder.
Figure 38:
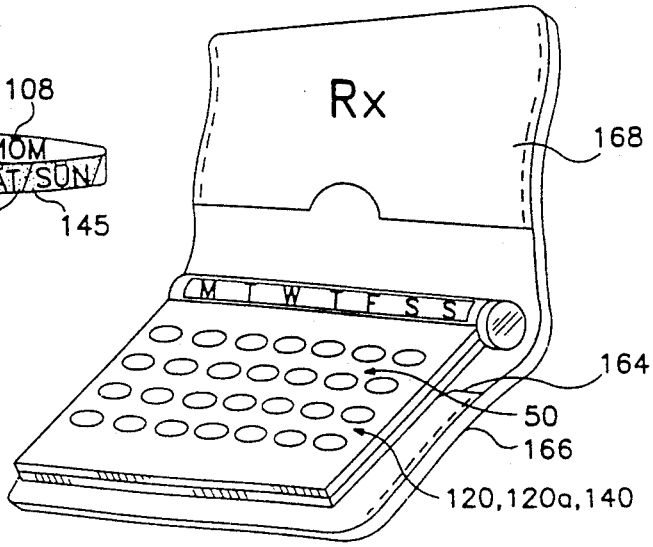
FIG. 38 is a perspective view of the holder of FIG. 37.

Container Holder—FIGS. 37 and 38

The blister pack container 120, 120*a* and 140 of FIGS. 24-35 each have blister packs 50 which are readily visible. In order to maintain the users privacy, the containers 120, 120*a* and 140 may be carried in a plastic retainer 162 resembling a wallet or business card holder which has a pocket 164 for retaining the container formed in a back flap 166 of the retainer. The container 120, 120*a* or 140 is then concealed by a front flap 168 hinged to the back flap 166. If desired, the plastic retainer 162 may, of course, also be used to carry the four panel tablet containers 60 and 60*a*.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. An assembly for containing tablets in an array, the assembly comprising:

a blister pack having a predetermined area containing a plurality of tablets disposed in a tableted area of the blister pack and configured in a selected array;

a container comprising a deck and a cover;

the deck including a flat surface with a plurality of openings therethrough, the openings being arrayed to correspond to the selected array of tablets in the blister pack;

the cover including a rim portion of an area larger than the tableted area of the blister pack and a window portion of an area less than the predetermined area of the blister pack and larger than the tableted area;

an indicator in the form of a projection positioned proximate the window portion of the cover so as to be visible when the cover is closed and a locator in the form of a notch proximate an edge of the blister pack, the indicator being registerable with the locator to properly position the blister pack with respect to the deck and the window portion;

daily calendar means associated with the assembly and alignable with the array of tablets, the daily calendar means being shiftable to position a selected starting day with a first tablet in the array; and hinge means for securing the cover to the deck with the blister pack therebetween whereby the tablets and blister pack are visible and accessible through the window portion of the cover and dispensable through the openings in the deck by pressing on the tablets through the window portion.

2. The assembly of claim 1, wherein the tablets are arranged in rows of seven tablets and columns of four tablets or rows of seven tablets and columns of three tablets;

wherein the cover includes indicia thereon adjacent each column naming the day of the week; and wherein the indicator on the cover points to the first tablet in the array.

3. The assembly of claim 2, wherein the blister pack has indicia thereon indicating the order in which the tablets are to be consumed.

4. The assembly of claim 3, wherein the daily calendar means is a cylindrical calendar with seven lines of days whereby a starting day arranged axially therein is selected by rotating the calendar.

5. The assembly of claim 4 further including means for locking the cylindrical calendar in a selected position.

6. The assembly of claim 3, wherein the calendar means is a loop positioned on the deck, the loop being moveable with respect to the deck to position a selected day adjacent a first tablet in the array.

7. The assembly of claim 6 further including means for locking the loop in a selected position.

8. The assembly of claim 7, wherein the locking means comprises a detent movably mounted on the housing and a series of recesses in the loop wherein the detent selectively engages one of the recesses to retain the loop in the selected position.

9. The assembly of claim 8, wherein the loop includes a tab fixed thereto and wherein the cover includes as lot with which the loop is registered and through which the tab projects.

10. The assembly of claim 1, wherein the indicator is formed in the deck as a fixed projection and wherein the indicator has indicia thereon for informing a person using the assembly where to start.

11. The assembly of claim 1, wherein the indicator and notch are both triangular.

12. The assembly of claim 1, wherein the tablets are birth control tablets.

13. The assembly of claim 1, wherein the tablets are HRT tablets.

14. An assembly for containing tablets in an array, the assembly comprising:

a blister pack having a predetermined area containing a plurality of tablets disposed in a tableted area of the blister pack and configured in a selected array;

a container for mounting the blister pack, the container comprising a deck and a cover;

the deck including a flat surface with a plurality of openings therethrough, the openings being arrayed to correspond to the selected array of tablets in the blister pack;

the cover including a rim portion of an area larger than the tableted area of the blister pack and a continuous window portion of an area less than the predetermined area of blister pack and larger than the tableted area;

an indicator proximate the window portion of the cover and a locator proximate an edge of the blister pack, the indicator being registerable with the locator to properly position the blister pack within the window portion;

daily calendar means associated with the assembly and alignable with the array of tablets, the daily calendar means being shiftable to position a selected starting day with a first tablet in the array;

hinge means for securing the cover to the deck with the blister pack removably mounted therebetween whereby the tablets and blister pack are visible and accessible through the window portion of the cover and dispensable through the openings in the deck by pressing on the tablets through the window portion;

a front lid and a back lid, the front lid being hinged to the cover, and the back lid being hinged to the deck; and latching means on the front lid and back lid for latching the lids to one another, whereby the blister pack, cover, and deck are sandwiched between the lids.

15. The assembly of claim 14, wherein the tablets are arranged in rows of seven tablets and columns of four tablets or rows of seven tablets and columns of three tablets, wherein the cover includes indicia thereon adjacent each column naming the day of the week and wherein the indicator means on the cover points to the first tablet in the array.

16. The assembly of claim 15, wherein the blister pack has indicia thereon indicating the order in which the tablets are to be consumed.

17. The assembly of claim 14, wherein the tablets are birth control tablets.

18. The assembly of claim 14, wherein the tablets are HRT tablets.

19. The assembly of claim 14, wherein the daily calendar is in the form of a loop looped around a portion of the deck aligned with a slot in the cover wherein the days of the week are displayed through the slot.

20. The assembly of claim 19 further including a tab accessible through the slot for shifting the loop whereby the selected starting day is alignable with the first tablet in the array of the blister pack when the blister pack is mounted between the deck and cover.

21. The assembly of claim 20 further including a plurality of holes in the deck aligned with the loop and a detent fixed to the tab and received in a selected one of the holes to releasably fix the loop with respect to the blister pack.

22. The assembly of claim 19 further including a plurality of holes in the deck aligned with the loop and detent fixed to the loop and received in a selected one of the holes to releasably fix the loop with respect to the blister pack.

* * * * *